United States Patent [19]

Jeannet et al.

[11] 4,412,751

[45] Nov. 1, 1983

[54] JOINTED ELECTRONIC WATCH

[75] Inventors: Pierre Jeannet, Chambrelien; Raymond Froidevaux, Bienne; Claude-André Gygax, Evilard, all of Switzerland

[73] Assignee: Omega SA, Bienne, Switzerland

[21] Appl. No.: 410,760

[22] Filed: Aug. 23, 1982

[30] Foreign Application Priority Data

Aug. 25, 1981 [CH] Switzerland ..... 5463/81

[51] Int. Cl.[3] ..... G04C 03/00; G04B 37/12; G04B 23/12

[52] U.S. Cl. ..... 368/276; 368/204; 368/282

[58] Field of Search ..... 368/88, 276, 280, 281, 368/282, 292, 313, 10, 204, 12, 250, 225, 227, 224, 291, 309, 310

[56] References Cited

U.S. PATENT DOCUMENTS 3,971,207 7/1976 Murakami et al. ..... 368/282 X
3,973,706 8/1976 Boyce et al. ..... 368/204 X
3,977,176 8/1976 Murakami et al. ..... 368/282 X

FOREIGN PATENT DOCUMENTS 1974325 5/1967 Fed. Rep. of Germany .
1137844 6/1957 France .
2240475 8/1973 France .
587471 4/1977 Switzerland .
1574730 9/1980 United Kingdom .

*Primary Examiner*—J. V. Truhe
*Assistant Examiner*—Terry L. Flo
*Attorney, Agent, or Firm*—Griff n & Butler

[57] ABSTRA

A jointed electronic watch co urality of watch cases each capable of bea t type of display and an energy source. Be k covers (4, 5, 6) and case bands of each dwiched seals (9, 10, 11) which are coup y isth- muses (12) at the line of articulati ack covers and which are formed as a sing Within the isthmuses are arranged electrical adapted to couple together the various mponents within the plurality of cases.

8 Claims, 6 Drawing F

11
12
14
C
B
B
10
12
A
A
14
9
12
14

JOINTED ELECTRONIC WATCH

BACKGROUND OF THE INVENTION

The invention concerns a jointed electronic watch comprising at least two watch-cases coupled by an articulation each of said cases comprising a back cover, a case-band and a seal arranged between the back cover and said case-band.

A jointed watch is already known from the German utility model No. 1 974 325 which describes a bracelet in which the links may comprise a watch and a mechanical counter. More recent realizations have disclosed wrist-watches comprising a principal case and links which enclose push-buttons or a battery.

British Pat. No. 1,574,730 describes an electronic watch provided with hollow links containing control members and a battery. These links are realized in plastic and are molded in a single piece with the case-band of the principal watch-case itself closed by a crystal and a back cover. An electrically conducting film connects the control members and the battery to the circuits of the watch by passing through the interior of the joints situated between the case-band and the first link and between the links themselves, such articulations being formed by a thinning down of the plastic material at this location. Such construction, although having the advantage of assuring a good sealing between the case and the links is not adapted to provide an aesthetically satisfying aspect from the fact of utilizing plastic material.

The arrangement described in U.S. Pat. No. 3,973,706 shows a battery which is lodged in a link of plastic material of a metallic bracelet. The connection between the battery and the watch circuits is realized by means of elastic tongues of which the extremities are located in a contact pin. Such contact pin is engaged through the case-band bezel with the contact terminals thus providing a plug-in contact. If the described construction aims above are to obtain an easy replacement of the battery, it cannot be applied to an articulated watch as set forth in the present invention since it requires too much space should more than two conductors be necessary.

Numerous other solutions have been proposed in order to enter a watch-case with electric conductors. Thus, in French Pat. No. 1 137 844 where the energy source is found within the bracelet, there has been shown means to couple said source to the electrical circuit of the watch. It will be noted however that no means has been provided to assure sealing of the watch where the conductors pass therethrough. It may be determined in particular that such conductors are sandwiched between two surfaces, this being insufficient to provide a good sealing.

Within a search report has been cited U.S. Pat. No. 3,971,207. The article described therein is characterized by a seal comprising a first elastic joint assuring the sealing of the case of the watch and a coupling towards the exterior of the latter realized in an elastic and flexible conductive material. However, in contrast to what is taught by the present invention and as will appear in the following, the seal described in the cited patent has not been made in a single piece at the point at which it is desirable to isolate the conductors from the metallic portions of the various components of the watch case (see FIGS. 8 and 9 of the cited document). Moreover, the proposed arrangement renders impossible the utilization of a printed circuit having multiple conductors therein which may be directly soldered onto the internal components of the watch. In the cited patent effectively, the connections (limited to two) are realized by supporting the contact members on the current conductors which are elastic. Such a form of connection is undesirable, above all for conducting current from the battery since it brings about an appreciable voltage drop. Thus, the advantageous arrangements which will be described hereinafter and are illustrated in particular by FIGS. *2a* and *2b* are neither described nor even suggested in the cited patent.

The present invention proposes to overcome the cited drawbacks and describes an arrangement which assures a sealed passage of the conductors from one case to the other of an articulated watch thanks to the claimed means.

FIG. *2a* is a plan view of the seal mounted in the watch, and

FIGS. *2b* and *2c* are sections along lines A—A and B—B of FIG. 2 *a* respectively.

FIG. *3a* is a section of the watch when two of the cases are arranged as a prolongation of one another.

FIG. *3b* is a section of the watch when two of the cases are inclined respectively to one another.

DETAILED DESCRIPTION OF THE INVENTION

Figure 1:
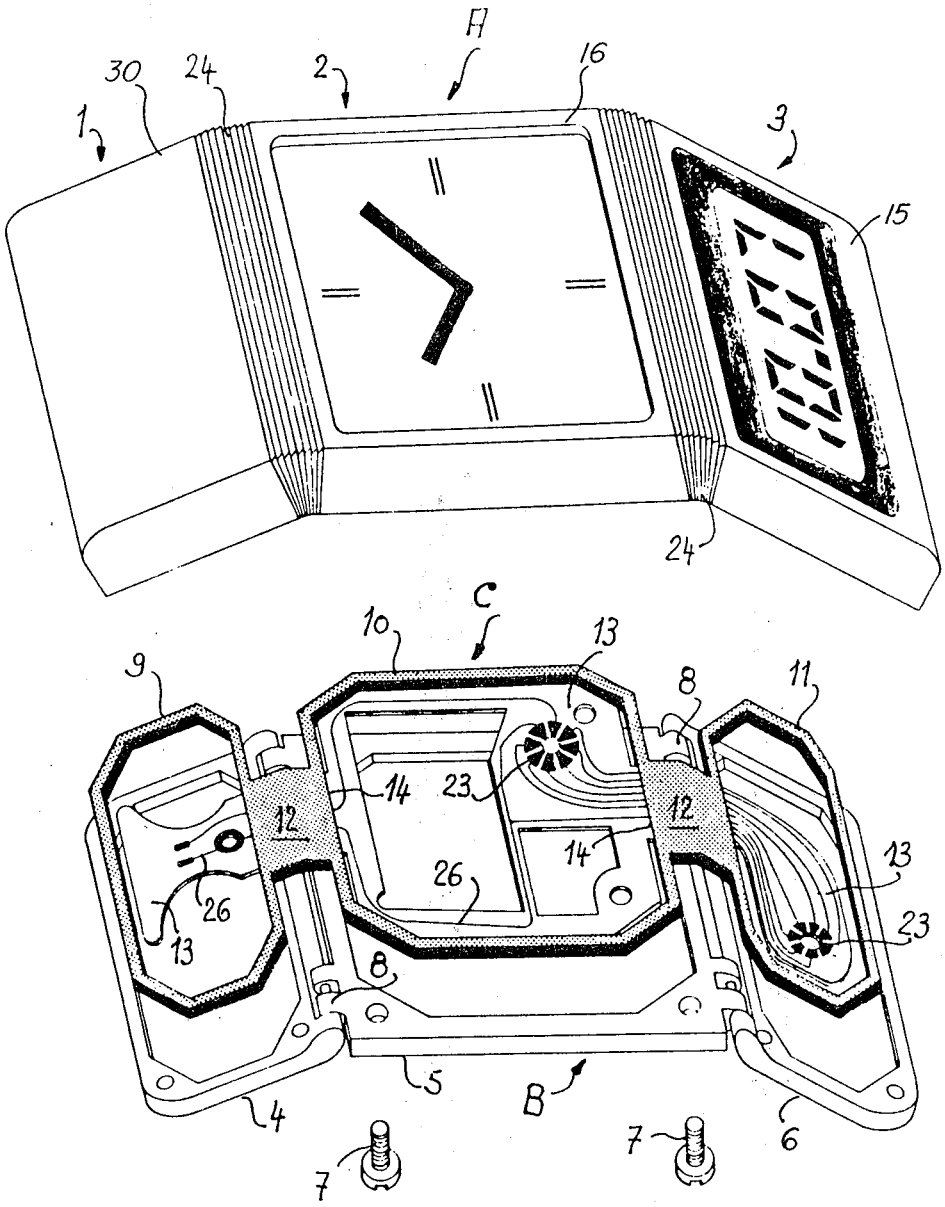
FIG. 1 is an exploded perspective of the jointed watch according to the invention.

The articulated watch of this invention is shown in an exploded view on FIG. 1. It is comprised essentially of three principal portions.

Part A is an arrangement comprising three cases, each following the other. Case 1 contains one or several batteries in order to assure energization of the watch. The central case 2 contains an arrangement permitting an analog display of the time of day with the necessary circuits to this end such as a quartz frequency standard, frequency dividers, time setting circuits, stepping motor, etc. Case 3 contains a display system which may for instance employ liquid crystals and the circuits typically necessary to such display as for instance decoding circuits.

Part B comprises the back cover of the watch. Back covers 4, 5 and 6 may be screwed to the case-bands 30, 16, and 15 of cases 1, 2 and 3 respectively by means of screws 7. The figure shows as well that the back covers 4, 5 and 6 are jointed to one another by means of hinges 8.

Between the case-bands 30, 16, and 15 of cases 1, 2 and 3 and back covers 4, 5 and 6 there will be found a dust and moisture blocking seal C having the dual purpose of blocking the penetration of moisture or dust to the interior of the watch and at the same time assuring a sealed passage for the electrical conductors coupling the watch cases to one another. As may be seen on FIG. 1, this seal comprises three parts 9, 10 and 11 which are sandwiched between the back covers 4, 5, 6 and the case-bands 30, 16, and 15 of the cases 1, 2 and 3 whenever the back covers are screwed onto the case-bands in order to assure a total sealing of the various compartments. The seals are coupled together at the line of articulation by a passage which is shown in the form of an isthmus 12. These passages are integral with the joints and are obtained in a single piece therewith in order to obtain a seal C which is manufactured in a single operation. Through the isthmuses 12 pass conductors 26 which form an integral portion of a flexible printed circuit 13, itself realized in a single piece.

Figures 2A, 2B, 2C:
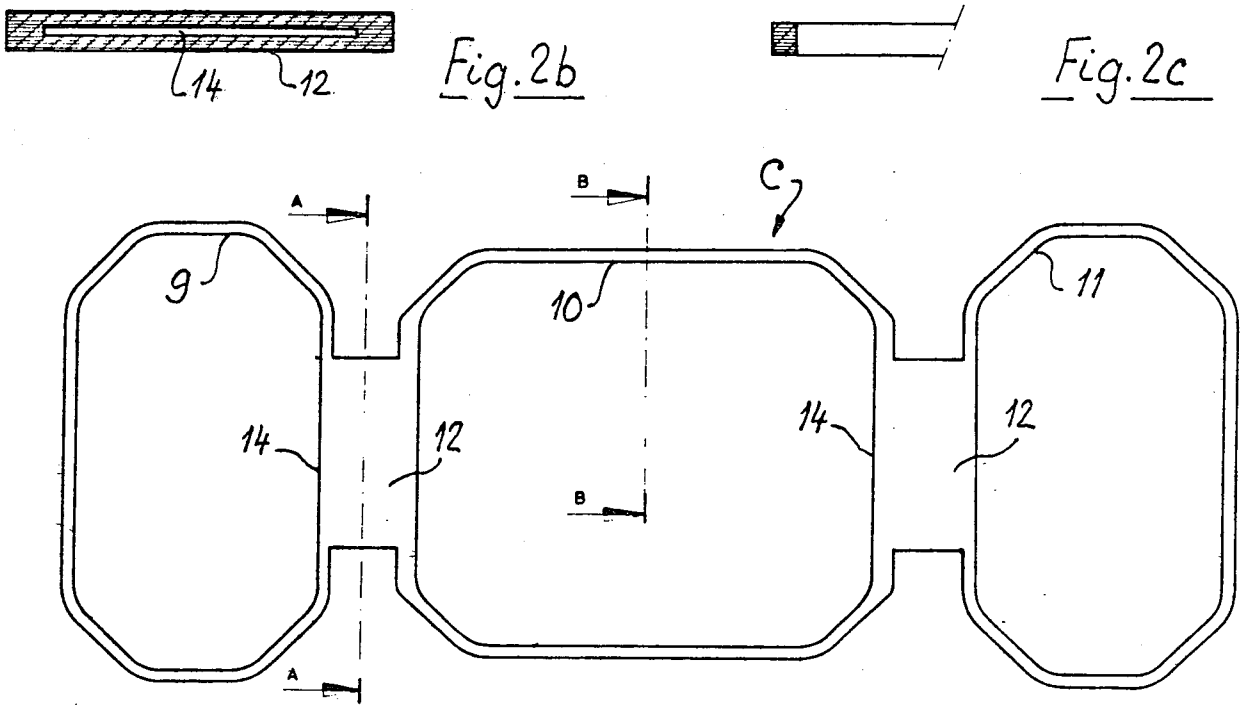

FIG. 2*a* shows in plan view the seal of this invention. There will be found parts 9, 10 and 11 serving to seal the several cases of the watch. The isthmuses 12 couple the parts and serve as passages for the electrical conductors as may be seen in FIG. 2*b* which is a cross-section at double the scale according to line A—A of FIG. 2*a* and where a tunnel 14 is shown. FIG. 2*c* is a cross-section according to line B—B of FIG. 2*a* and shows that the thickness of part 10 is the same as that of the isthmuses 12 at least as shown in the present realization. As has already been said, this seal is realized in a single piece and may be molded in one operation. In order to obtain at the same time the function of sealing and that of flexibility, one may employ rubber or any suitable plastic material. In order to obtain opening 14, a core will be placed in the mold as is generally known in molding techniques. When the core has been removed, the desired tunnels will be provided.

The flexible printed circuit 13 is then introduced via tunnels 14 of isthmuses 12 from the interior of part 10 across isthmuses 12 each of the extremities of the circuit then emerging in its proper location in the frameworks formed by parts 9 and 11, as may be seen by referring back to FIG. 1.

Another method of manufacture of the seal C may be utilized by directly overmolding the latter onto a network of conductors 26 forming a grid and disposed directly within the mold. If such a method is employed, it will be understood that conductors 26 will be sealed within isthmuses 12.

Figure 3A:
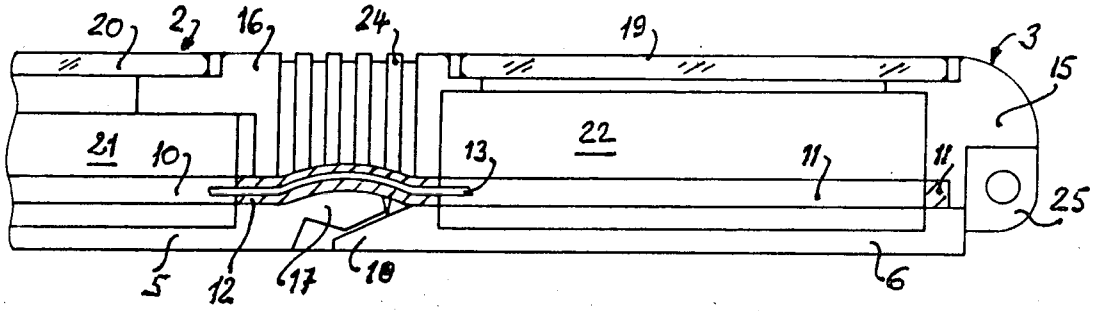
Figure 3B:
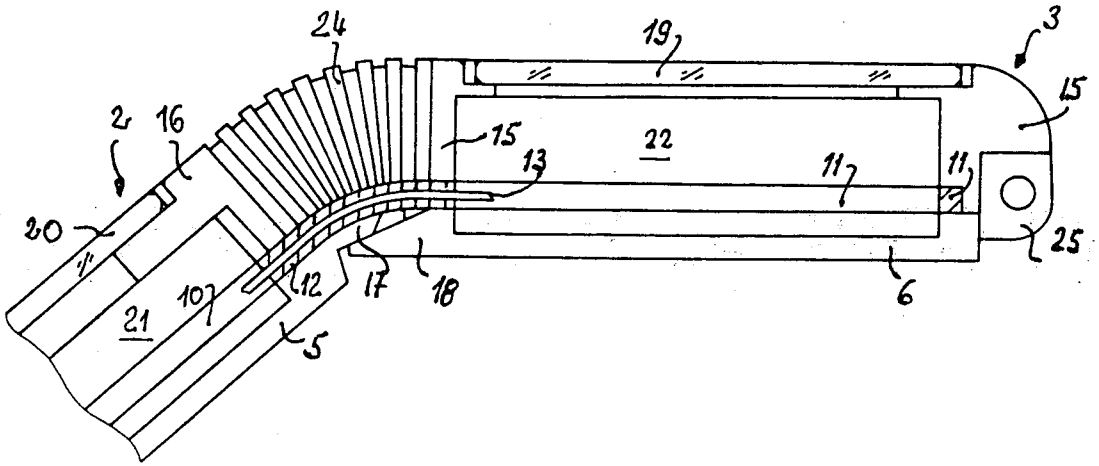

FIGS. 3*a* and 3*b* are longitudinal cross-sections of the jointed watch shown in FIG. 1 for which only case 3 and a portion of case 2 have been shown. It is seen how the part 11 is sandwiched between the back cover 6 and the case-band 15 of case 3. In the same manner part 10 is sandwiched between back cover 5 and the case-band 16 of case 2. Parts 10 and 11 are coupled together by isthmus 12 which contains the flexible printed circuit 13.

FIG. 3*a* shows cases 2 and 3 disposed as a prolongation of one another. In this position, isthmus 12 through its flexibility is humped as shown. In FIG. 3*b* to the contrary, cases 2 and 3 are inclined with respect to one another, the angular disposition being limited by extensions 17 and 18 provided respectively on back covers 5 and 6. In this case the isthmus takes the rounded position shown in this figure. The two figures show that the cases are closed by crystals 19 and 20, that under crystal 20, at location 21, may be lodged an analog display and that under crystal 19, at 22, there may be placed a digital electronic display module. Conductors 26 in a planar arrangement are to be found at the same level as the seal and are connected to the various electronic components by means of connection stars as may be seen on FIG. 1 under reference 23. Finally, a bellows 24 conceals the articulation and the isthmuses through being superposed thereover. Case-band 15 comprises means 25 which may serve to attach a bracelet (not shown).

It will be understood that the fact of joining several cases which may at the same time function as links in a bracelet permits the obtaining of an elegant watch of very flat nature since the various elements which compose it may be judiciously separated out into the space available. In the example as shown, the larger and more encumbering elements which are generally the batteries have been placed into a separate link, thus permitting utilization of the freed space in the central case in order to place the electronic elements. In the same manner, in a side link which provides the digital display, it has been possible to place the control circuits for this display, thus permitting to reduce to a minimum the number of conductors which must traverse the isthmus. It will be noted furthermore that the proposed arrangement permits changing the batteries without having to open a case containing the Displays. This is an advantage as far as reliability is concerned.

The jointed watch as described is not limited to the combination as illustrated. Many other arrangements may be imagined which would include further links adapted to include for instance a sound source, control push pieces, a calculator, a temperature sensor, a compass, etc. The base principle remains however that in order to realize properly such a construction, a certain and reliable solution must be found in order to couple electrically the several links whereby to assure perfect sealing. Such a solution has just been described which requires the use of a seal comprising several parts coupled together by isthmuses, said seal assuring at the same time the sealing of the cases which are required for the overall composition of the watch and permitting sealed passage of the electrical conductors from one case to another.

What we claim is:

1. A jointed electronic watch comprising at least two watch-cases coupled together by an articulation, each of said cases comprising a back cover, a case-band and a seal located between the back cover and the case-band wherein the seals are coupled together at the line of articulation by an isthmus formed of the same material as the seals and being integrated therewith so as to form a moisture and dust blocking seal in one piece, electrical conductors being located within the isthmus thereby to assure a sealed passage for electric connections between the watch-cases.

2. A jointed electronic watch as set forth in claim 1 wherein a tunnel is arranged within the isthmus adapted to accomodate a flexible printed circuit bearing said electrical connections.

3. A jointed electronic watch as set forth in claim 1 wherein the electrical connections are held within the isthmus by overmolding of material constituting the seal.

4. A jointed electronic watch as set forth in claim 1 wherein three cases are provided each including a seal arranged between the back cover and case-band and two isthmuses coupling the respective lines of articulation, the central case bearing analog display means, a first lateral case bearing digital display means and the second lateral case bearing an energy source.

5. A method of manufacture of the watch as set forth in claim 1 comprising the step of molding in a single operation the seals and the isthmus joining them so as to form the moisture and dust blocking seal as a single piece.

6. A jointed electronic watch comprising at least two watch-cases coupled together by an articulation, each of said cases comprising a back cover, a case-band, and a seal located between the back cover and the case-band wherein the seals are coupled together at the line of articulation by an isthmus formed of the same material as the seals and being integrated therewith so as to form a moisture and dust blocking seal in one piece, said isthmus having a tunnel for receiving electrical conductors between the watch-cases.

7. A jointed electronic watch as set forth in claim 6 wherein said tunnel within said isthmus is adapted to accommodate a flexible printed circuit bearing said electrical conductors.

8. A jointed electronic watch comprising at least two watch-cases coupled together by an articulation, each of said cases comprising a back cover, a case-band, and a seal located between the back cover and the case-band wherein the seals are nonconductive and are coupled together at the line of articulation by an isthmus formed of the same nonconductive material as the seals and being integrated therewith so as to form a moisture and dust blocking seal in one piece, electrical conductors being located within the isthmus thereby to assure a sealed passage for electric connections between the watch cases.

* * * * *